United States Patent [19]

Smith

[11] Patent Number: 4,580,425

[45] Date of Patent: Apr. 8, 1986

[54] HIGH SECURITY LOCK

[76] Inventor: Jerry R. Smith, 5690 Rowland Ave., Littleton, Colo. 80123

[21] Appl. No.: 549,079

[22] Filed: Nov. 7, 1983

[51] Int. Cl.[4] ..... E05B 63/00

[52] U.S. Cl. ..... 70/421; 70/364 A

[58] Field of Search ..... 70/419, 421, 358, 364 A, 70/416

[56] References Cited

U.S. PATENT DOCUMENTS

| | | | |
|---|---|---|---|
| 1,707,922 | 4/1929 | Pepper | 70/421 |
| 2,298,698 | 10/1942 | Hofmann | 70/358 |
| 2,977,786 | 4/1961 | Kendrick et al. | 70/364 A |
| 3,195,330 | 7/1965 | Bauer | 70/421 |
| 3,260,082 | 7/1966 | Bodek et al. | 70/421 |
| 3,541,822 | 11/1970 | Murphy | 70/421 |

FOREIGN PATENT DOCUMENTS

| | | | |
|---|---|---|---|
| 1371985 | 8/1964 | France | 70/364 A |
| 1487597 | 5/1967 | France | 70/364 A |

*Primary Examiner*—Robert L. Wolfe

*Attorney, Agent, or Firm*—James R. Young

[57] ABSTRACT

A pick resistant lock includes a secondary hole in the cylinder which is turned into alignment with a driver pin as the lock is being opened. A shuttle pin slidably positioned in the secondary bore prevents the driver pin from entering the secondary bore when a key bit is inserted in the key way. However, when there is no key bit in the key way, the driver pin will drop into the secondary bore and prevent opening the lock. Two embodiments of the lock also include features to prevent the driver pin from being pushed out of the secondary bore without disassembling the lock. In one of these embodiments, the shuttle pin is locked against movement by a tertiary pin, and in another embodiment, the service pin blocks access to the shuttle pin to accomplish this result.

8 Claims, 23 Drawing Figures

HIGH SECURITY LOCK

BACKGROUND OF THE INVENTION

The present invention is related to lock apparatus and more specifically to an improved pick resistant cylinder lock.

Conventional cylinder locks are used extensively for numerous applications in locking such items as door latches, ignition switches, padlocks, and the like. They are reliable, require little maintenance, and are conducive to a variety of key fitting combinations. Conventional cylinder locks, however, are conducive to unauthorized opening by "picking." Usually, the lock "picking" is accomplished by holding an angular bias on the key plug while using a narrow, elongated rigid tool to move the individual tumbler pins until the shear line between the key plug and cylinder housing is uninterrupted. While such a procedure is usually difficult for a novice, some persons become quite proficient at opening cylinder locks without keys. Therefore, there is a need for higher security cylinder locks that retain all the desirable features associated with cylinder locks and which are capable of foiling would be lock pickers.

SUMMARY OF THE INVENTION

Accordingly, it is an object of this invention to provide a novel improvement for cylinder locks which resist being opened by conventional lock picking techniques.

It is also an object of the present invention to provide an improvement in cylinder locks that prohibits turning the key plugs in such locks beyond a predetermined angle without the presence of a key bit in the keyway.

A further object of the present invention is to provide an anti-picking feature that includes a secondary lock mechanism that positively prohibits rotation of the key plug within the cylinder housing without a key bit in the keyway and which cannot be unlocked without disassembling or breaking the lock.

The improvements in cylinder lock apparatus of the present invention in keeping with the objects described above include a secondary bore in the key plug extending radially inward from the peripheral surface of the key plug and adapted to partially receive therein the driver pin when the key plug is rotated to align the secondary bore with the driver pin. An elongated spacer or shuttle pin is positioned in the secondary bore to interact with a key bit positioned in the key way to prohibit protrusion by the driver pin into the secondary bore when a key bit is positioned in the key way, but allowing protrusion therein by the driver pin when there is not a key bit positioned in the keyway. When the driver pin is allowed to protrude partially into the secondary bore, it breaks the shear plane between the key plug and the cylinder housing to prohibit further rotation of the key plug. A spring biased lock pin adjacent the secondary bore is adapted to slide into engagement with the driver pin when the driver pin is positioned partially in the secondary bore across the shear line.

BRIEF DESCRIPTION OF THE PREFERRED EMBODIMENT

Other objects, advantages and capabilities of the present invention will become apparent as the description proceeds, taken in conjunction with the accompanying drawings, in which.

DESCRIPTION OF THE PREFERRED EMBODIMENT

Figure 1:
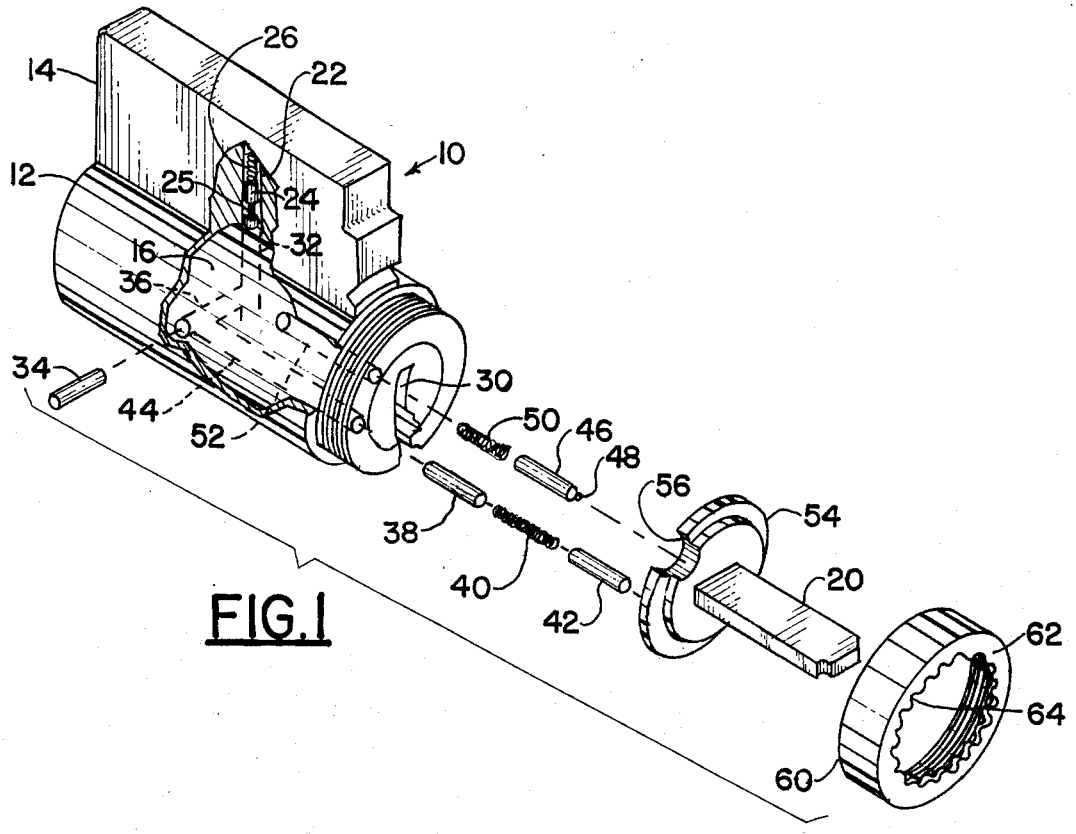
FIG. 1 is an exploded perspective view of the improved lock apparatus of the present invention.

The improved cylinder lock apparatus of the present invention is shown in FIGS. 1 through 12. For an understanding of the improvements of this invention, a brief description of the conventional components of the cylinder lock is necessary. Such description is best accomplished by reference to FIGS. 1 through 4. The lock apparatus 10 includes a conventional cylinder housing 12 with a cylindrical key plug 16 rotatably positioned therein. A chamber housing 14 extends upwardly from cylinder housing 12 and includes therein a plurality of linearly spaced apart chamber pin bores, such as those designated at 22, 79. There are usually at least five of six such pin bores in the chambers of conventional cylinder locks; however, those illustrated herein by the cutaways in the drawings are sufficient for purposes of describing the improvements in this invention.

A flange 18 on the front end of the key plug 16 and a threaded cap 60 screwed onto the rear end of the key plug from the cylinder housing 12. A keyway channel 30 extends longitudinally through the key plug 16.

A plurality of pin tumbler holes in spaced-apart relation to each other in the key plug 16 extend radially outwardly from the keyway 30 to the peripheral surface of the key plug 16 where they can be aligned with the pin bores 22, 79 in the chamber when the key plug 16 is rotated. Elongated service tumbler pins 28, 78 are positioned respectively in the pin tumbler holes 32. Driver pins 24, 76 are positioned in the chamber pin bores 22, 79 and are biased by springs 26, 77 toward the key plug 16.

Figure 2:
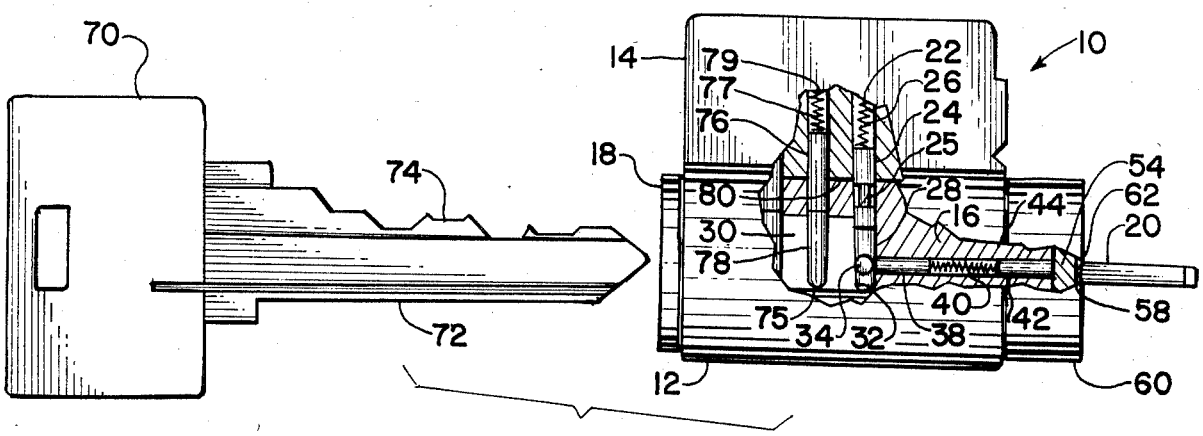
FIG. 2 is a side elevation view of the improved lock apparatus of the present invention with a portion of the side of the cylinder housing and a portion of the key plug cut away to illustrate the features of the present invention.
Figure 3:
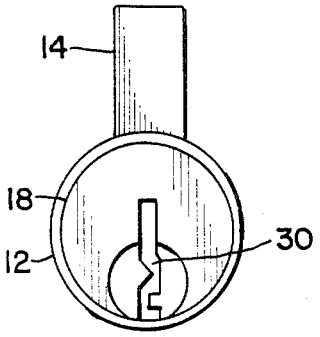
FIG. 3 is a front elevation view of the lock of the present invention.

When the service pin holes 32, 75 are aligned with the chamber pin bores 22, 79, the driver pins 24, 76 protrude partially into the service pin bores 32, 75 in the key plug 16 in such a manner that they are positioned across the shear line 80 between the key plug 16 and the cylinder housing 12, as shown in FIG. 2. In this position, the key plug 16 cannot be rotated in relation to the cylinder housing 12, so the apparatus is effectively locked in the conventional manner.

When a key bit 72 of a key 70 with appropriate key bitting 74 thereon, such as that shown in FIG. 2, is inserted into the keyway 30, the key bitting 74 acts on the service pins 28, 78 to push the driver pins 24, 76 upwardly to a position where the interfaces between the service pins and the driver pins align with the shear plane 80. In that position, the key plug 16 can be rotated and the lock can be opened.

Figure 4:
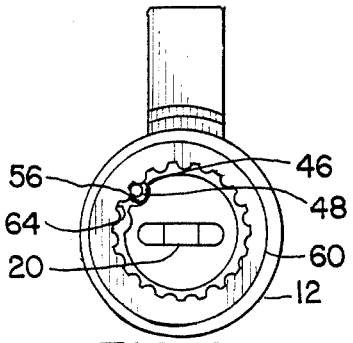
FIG. 4 is a rear elevation view of the lock of the present invention.

To complete the description of a conventional lock, an end plate 54 with a blade link 20 protruding outwardly therefrom is positioned at the rear end of the key plug 16 before screwing the end cap 60 into place. A latch pin 46 and a spring 50 are positioned in a short longitudinal bore 52 in the end of the key plug to provide a latch for retaining the end cap 60 screwed onto the rear end of the key plug 16. As best shown in FIG. 4, a smaller diameter extension 48 protrudes outwardly from the rear end of the latch pin 46 into engagement with one of the plurality of notches 64 on the collar 62 of end cap 60. When the end 48 of latch pin 46 is so engaged with the notches 64, the end cap 60 cannot be unscrewed from the rear end of the key plug 16. By depressing the latch pin 46 against the bias of spring 50, however, the end cap 60 can be unscrewed and removed from the end of the key plug 16.

The blade link 20 is provided to protrude rearwardly from the end of the key plug 16 into engagement with appropriate door latching apparatus (not shown) or other apparatus which is intended to be operated or turned by the lock. A partial notch 56 is provided in the peripheral surface of the end plate 54 to engage the latch pin 46 in such a manner that the end plate 54 and blade link 20 rotate with the key plug 16 as the lock is opened.

Turning now to the novel lock improvement features of the present invention, reference in made to FIGS. 1, 2, 5, and 6 for a description thereof. The key plug 16 of the present invention includes a transverse secondary bore 36 extending radially inward from the peripheral surface of the key plug 16 and angularly space distance from one of the service pin holes 32 and intercepting the keyway 30. A shuttle pin 34 is slideably positioned in the secondary or shuttle bore 36. The shuttle pin 34 is of a length sufficient to extend from the edge of keyway 30 to the peripheral surface of the key plug 16. In this position, the outer end of shuttle pin 34 is flush with the shear line 80 between the shear plug 16 ane the cylinder housing 12.

A tertiary bore 44 extends longitudinally from the rear end of the key plug 16 forwardly to intersect with the secondary bore 36. An elongated lock pin 38, a compression spring 40, and a spacer pin 42 are slideably positioned in the tertiary or lock pin bore 44 prior to positioning the end plate 54 over the end of key plug 16. When the spacer pin 42 is anchored against the interior surface of the end plate 54, the compression spring 40 bears against spacer pin 42 and biases lock pin 38 forwardly toward the shuttle pin bore 36. The driver pin 24 is provided with a recessed groove around its midsection wide enough to receive therein the forward end of the lock pin 38, as will be described more fully below. While this preferred embodiment is shown and described with the spacer pin 42 in the tertiary bore 44, the force of the compression spring 40 is actually bearing against the end plate 54. Thus, spacer pin 42 could be eliminated leaving the spring 40 to actually contact the end plate 54.

Figure 6:
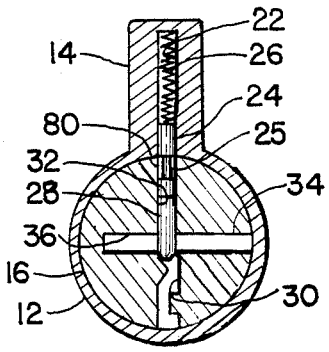
FIG. 6 is a cross-sectional view of the improved lock apparatus of the present invention taken along line 6—6 in FIG. 5.
Figure 5:
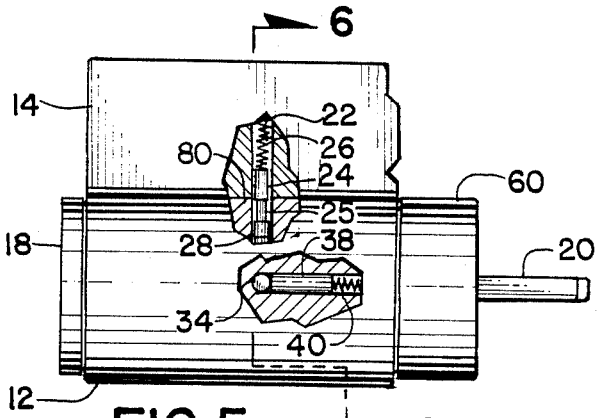
FIG. 5 is a side elevation view of the improved lock apparatus of the present invention showing the components in the normal lock position.

The positions of the components as shown in FIGS. 2, 5 and 6 are in the normal locked position with the driver pin 24 protruding downwardly into the service pin bore 32 and across the shear line 80 to prevent rotation of the key plug 16 in relation to the cylinder housing 12. At the same time, the shuttle pin 34 is positioned in the shuttle pin bore 36 between service pin 28 and cylinder housing 12, as best seen in FIG. 6. In that position, as best shown in FIG. 5, the lock pin 38 biased by spring 40 bears against shuttle pin 34, but is prohibited from protruding into shuttle pin bore 36 by the shuttle pin 34. Therefore, in the configuration shown in FIGS. 2, 5, and 6, the lock functions in the conventional manner of cylinder locks.

Figure 8:
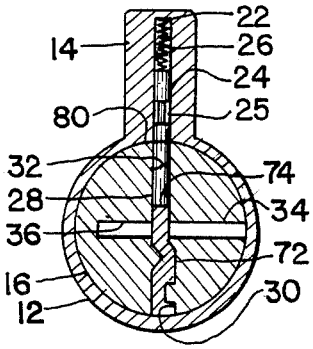
FIG. 8 is a cross-sectional view of the improved lock of the present invention taken along line 8—8 of FIG. 7.
Figure 7:
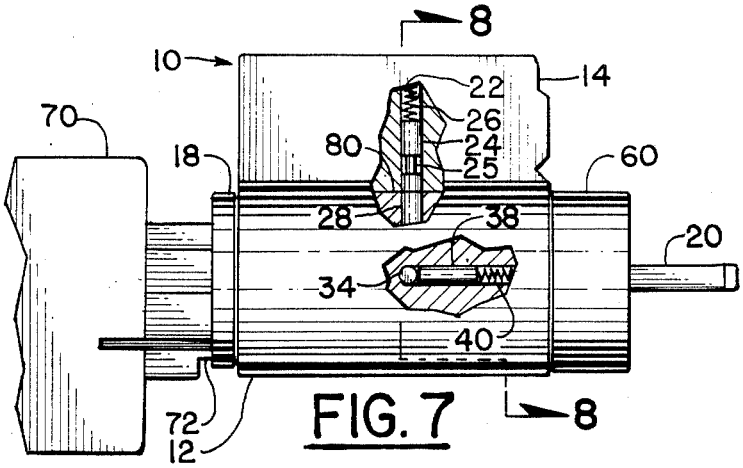
FIG. 7 is a side elevation view of the improved lock of the present invention with portions cut away showing the components in normal position for opening the lock with a key.
Figure 10:
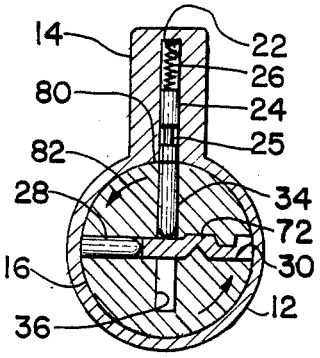
FIG. 10 is a cross-sectional view of the improved lock of the present invention taken along line 10—10 of FIG. 9.
Figure 9:
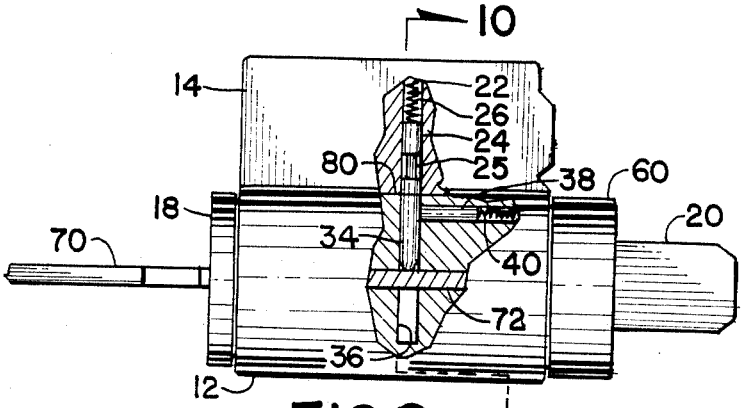
FIG. 9 is a side elevation view of the improved lock apparatus of the present invention with portions cut away disclosing operation of the lock with a key in normal position therein.

The lock can also be opened by a key in the conventional manner as shown in FIGS. 7 and 8. As the key bit 72 of key 70 is inserted into the keyway 30, the key bitting 74 acts on service pin 28 to push it upwardly. In turn, service pin 28 pushes driver pin 24 upwardly against the bias of spring 26 to align the interface between service pin 28 and driver pin 24 with the shear line 80. Assuming all of the rest of the tumbler pins in the lock are properly aligned with the shear line 80, as in conventional cylinder locks, the key 70 can then rotate key plug 16 in relation to cylinder housing 12 to open the lock in the conventional manner. As the key plug 16 is turned by the key, for example, as shown by the arrows 82 in FIG. 10, the shuttle pin bore 36 becomes aligned with the driver pin bore 22. With the shuttle pin 34 bearing against the side of key bit 72, however, the driver pin 24 is prohibited from dropping into shuttle pin bore 32 so that the shear line 80 remains unbroken and the key plug 16 can continue to turn beyond that position to open a latch mechanism to which the blade link 20 is attached (not shown). Throughout this operation, as shown in FIGS. 7 and 9, the lock pin 38 remains stationary and inactive by bearing against shuttle pin 34. Consequently, as long as the lock is opened with the appropriate key, the shuttle pin 34 remains positioned to prohibit the driver pin 24 from protruding into the shuttle pin bore 36, and the lock pin 38 remains stationary and inactive.

Figure 12:
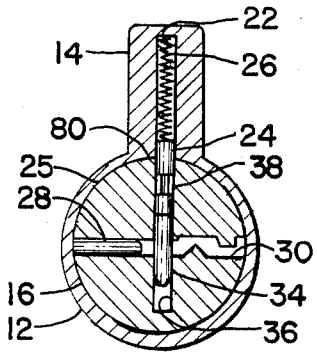
FIG. 12 is a cross-sectional view of the improved lock apparatus of the present invention taken along line 12—12 of FIG. 11.
Figure 11:
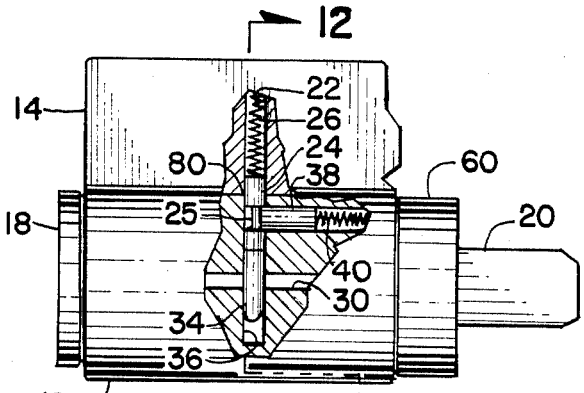
FIG. 11 is a side elevation view with a cutaway illustrating the components in a lock out position resulting from attempting to pick the lock.
Figure 13:
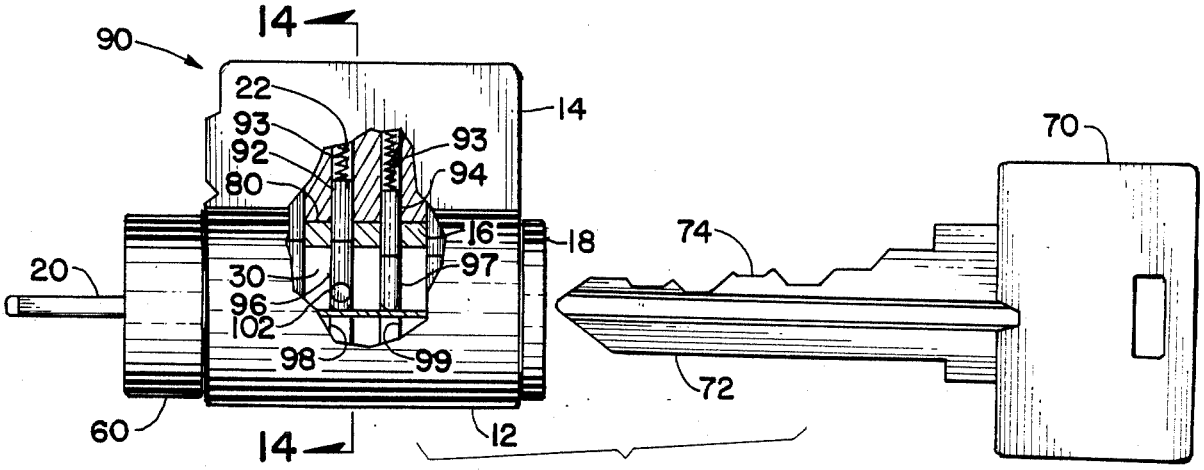
FIG. 13 is a side elevation view of an alternate second embodiment of the present invention.

In the event the lock is picked, however, such as by using picking tools to align the tumbler pins in such a manner as to not interrupt the shear line 80 so that the key plug 16 can be rotated and the lock opened without the use of the key, the shuttle pin 34 will be free to protrude through the keyway 30. When this happens, as shown in FIGS. 11 and 12, as the key plug 16 is rotated to open the lock, the shuttle pin bore 36 becomes aligned with the driver pin bore 22. As this alignment occurs, the driver pin 24 will drop into shuttle pin bore 36 and thereby interrupt the shear line 80 so that the key plug 16 cannot be turned any further. With the latch mechanism set up so that rotation to that extent is insufficient to open the door or other apparatus to which the lock is applied, the attempt to open the lock by picking without the appropriate key will be unsuccessful.

Further, as shown in FIGS. 11 and 12, when the driver pin 24 has protruded a sufficient distance into the shuttle pin bore 36 to align the recessed portion 25 of the driver pin 24 with the lock pin bore 38, a spring 40 biased the lock pin 38 into engagement with the recess 25 to prevent any further movement either up or down of the driver pin 24. When the driver pin 24 is locked in this psoition across the shear line 80 the lock is impossible to open without disassembling or destroying it.

Figure 14:
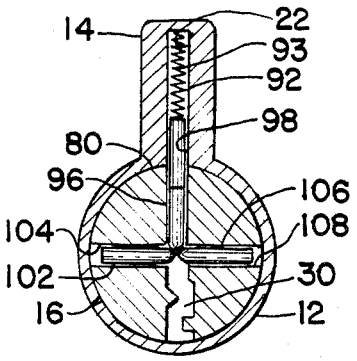
FIG. 14 is a cross-sectional view of the alternate second embodiment showing the components in normal lock condition taken along line 14—14 of FIG. 13.

The alternative embodiment shown in FIGS. 13 through 17 is a less secure version of the invention described above, in that it does not include the absolute lock feature. In this embodiment, a shuttle pin bore 108 extends diametrically through the key plug 16, as shown in FIG. 14, and a pair of shuttle pins 102, 106 are positioned therein.

Figure 15:
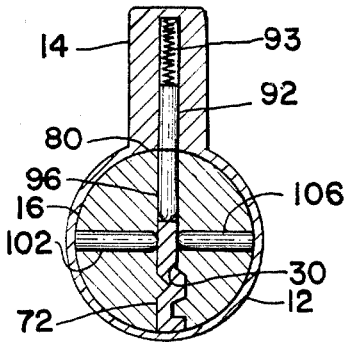
FIG. 15 is a cross-sectional view of the alternative second embodiment of FIG. 13 showing the components unlocked by a key bit therein.
Figure 16:
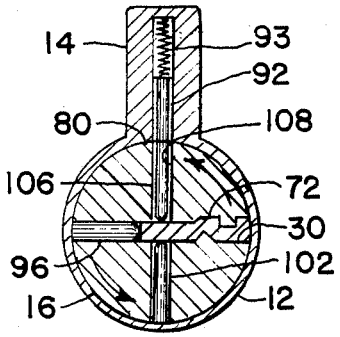
FIG. 16 is a cross-sectional view of the alternative second embodiment of FIG. 13 showing the components therein as the lock is being opened by a key bit therein.

In FIG. 14, the lock is shown in its normal locked condition with driver pin 92 interrupting the shear line 80. When a key bit 72 in inserted into the keyway 30 as shown in FIG. 15, service pin 96 is pushed upwardly until the interface between the driver pin 92 and service pin 96 is aligned with shear line 80, and the shuttle pins 102, 106 are positioned between the key bit and the cylinder housing 12 in such a manner that the outer ends of the shuttle pins 102, 106 are flush with the shear line 80. Therefore, as the key plug 16 is rotated by the key bit 72 to open the lock, as shown in FIG. 16, the shuttle pin bore 108 can be rotated past driver pin 92 without interruption.

Figure 17:
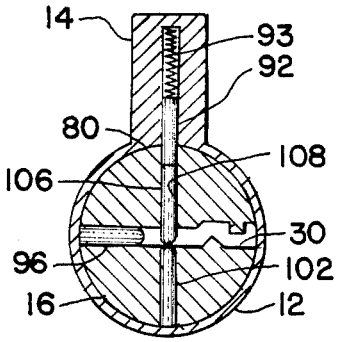
FIG. 17 is a cross-sectional view of the alternate second embodiment of FIG. 13 showing the components therein in the secondary lock out position resulting from attempting to open the lock by picking.

If the lock is picked, however, and the key plug 16 is rotated without the key positioned in keyway 30, as shown in FIG. 17, the driver pin 92 can drop into the shuttle pin bore 108 to a position interrupting the shear line 80. When this condition occurs, the key plug 16 cannot be rotated any further in either direction so that unauthorized opening of the lock is aborted.

This embodiment is less secure in that if a person picking the lock is aware of what happened, it would be possible to insert an appropriate picking tool into the keyway 30 and push the shuttle pin 106 upwardly a sufficient distance to align the interface between driver pin 92 and shuttle pin 106 with the shear line 80 to continue turning the lock.

Another alternate third embodiment 110 is shown in FIGS. 18–23. This third embodiment 110 includes a conventional cylinder housing 12 with a chamber housing 14 on top and a cylindrical key plug 16 inserted rotatably in the cylinder housing 12, as in the previous embodiments. The key plug 16 has a key way 30 extending longitudinally therethrough and a plurality of service pin holes 117 (only one illustrated) extending transversely therein in a common plane with and intersecting the keyway. The key plug 16 also has a shuttle pin hole 121 extending transversely therein at an angle to and intersecting with the service pin hole 117 and keyway 30. In the illustrations of FIGS. 18 through 23, the shuttle pin hole 121 is shown normal to the service pin hole 117; however, any reasonable and practical angle will suffice.

Figure 18:
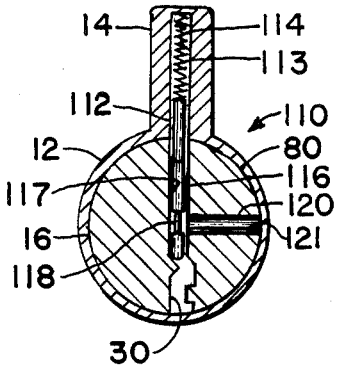
FIG. 18 is a cross-sectional view of an alternate third embodiment, taken along a plane similar to FIGS. 14—17 of the second embodiment, showing the components of the third embodiment in normal lock position.

As best seen in FIG. 18, a service pin 116 with a recessed portion 118 is positioned slideably in the service pin hole 117, and a driver pin 112 is positioned partially in the service pin hole 117 and extending into the driver pin hole 114 in chamber housing 14. The driver spring 113, positioned in the driver pin hole 114 above the driver pin 112 bears against the driver pin 112 to bias it downwardly toward the service pin 116. In this locked position, as illustrated in FIG. 18, the driver pin 112 is positioned across the shear line 80, thereby prohibiting rotation of the key plug 16 within the cylinder housing 12. As also shown in FIG. 18, a shuttle pin 120, equal in length to length of the shuttle pin bore 121 extending from the service pin bore 117 to the periphery of the key plug 16, is slideably positioned in the horizontal shuttle pin hole 121.

Figure 19:
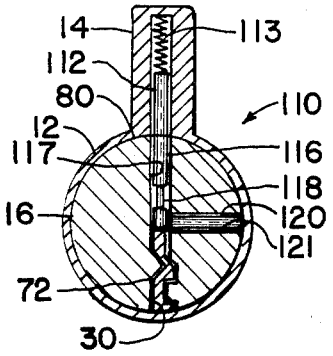
FIG. 19 is a similar cross-sectional view of the third embodiment showing the components unlocked by a key bit therein.
Figure 20:
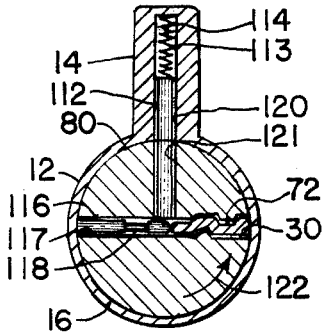
FIG. 20 is a similar cross-sectional view of the third embodiment showing the components therein as the lock is being opened with a key.

In normal operation, the lock 110 can be unlocked and turned with a key bit 72 inserted in keyway 30, as shown in FIG. 18. The key bit 72 pushes the service pin 117 and driver pin 112 upwardly against the bias of spring 113 a sufficient distance to align the interface between service pin 117 and driver pin 112 with the shear line 80. In this position, the key plug 16 can be rotated in the direction indicated by arrow 122 in FIG. 20. As the key plug 16 is rotated, the shuttle pin hole 121 is rotated into alignment with the driver pin hole 114. However, since the shuttle pin 120 is equal to the length of the shuttle pin hole 121, and the inside end of the shuttle pin 120 bears against the service pin 116 and/or the key bit 72, it prevents the driver pin 112 from entering the shuttle pin bore 121. In this manner, the shear line 80 is not interrupted by driver pin 112, and the key plug 16 can continue to be rotated beyond this position to unlock the apparatus to which the lock 110 is attached (not shown). Therefore, as long as the lock is operated in a normal manner with a key bit 72, as shown in FIGS. 19 and 20, no difficulties will be encountered, and the lock will function in a normal manner.

Figure 21:
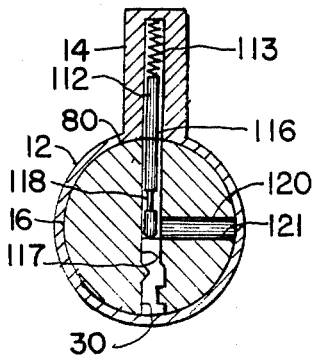
FIG. 21 is a similar cross-sectional view of the third embodiment showing the components in an opening position as when picked.
Figure 22:
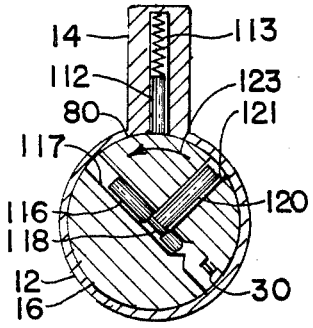
FIG. 22 is a similar cross-sectional view of the third embodiment showing the components in a partially opened position upon being picked.

In the event the lock is picked, the service pin 116 is raised by picking instruments (not shown) to the position shown in FIG. 21 wherein the interface between service pin 116 and driver pin 112 aligns with the shear line 80 so that the key plug 16 can be rotated. Once this alignment of the shear line is obtained and the key plug begins to rotate, a lock picker will usually terminate concentration on holding the dervice pins upwardly and will withdraw the picking tools and merely rotate the key plug 16, since the plug 16 will continue to rotate in conventional locks once the shear line is established. As the key plug is rotated in the direction indicated by the arrow 123 of FIG. 22, and the picking tools (not shown) are removed, the service pin 116 will fall by gravity back to the original position shown in FIG. 22. The shuttle pin 120 will also slide longitudinally by force of gravity in the shuttle pin hole 121 and into the recessed portion 118 of service pin 116.

When the shuttle pin 120 is positioned in the recessed portion 118 of service pin 116, a cavity is left in the shuttle pin bore 121 between the outer end of shuttle pin 120 and the peripheral surface of the key plug 16. Then, as the key plug 16 is rotated further in the direction indicated by arrow 124 in FIG. 23 until the shuttle pin bore 121 is aligned with the driver pin bore 114, the driver pin 112 will drop into the cavity in shuttle pin bore 121.

Figure 23:
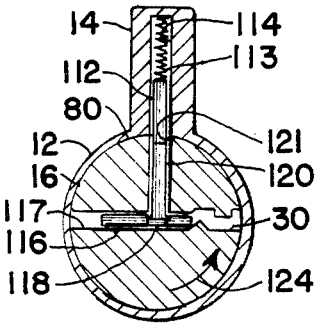
FIG. 23 is a similar cross-sectional view of the third embodiment showing the components in the secondary lock-out position resulting from attempting to open the lock by picking.

With the driver pin 112 protruding into the shuttle pin bore 121 as shown in FIG. 23, further rotation of the key plug 16 in either direction is prohibited. It is locken in place and cannot be moved. When the latch mechanism to which the lock 110 is connected is set up such that this amount of rotation is insufficient to open the latch mechanism, unlatching is prohibited and the lock picker will be unsuccessful in attempting to illegitimately open the lock. Further, once the shuttle pin 120 is in this position engaged with the recessed portion 118 of service pin 116 and the driver pin 112 protrudes into the shuttle pin bore 121, as shown in FIG. 23, none of these pins can be moved to a position where the key plug can be rotated without complete disassembly of the lock 110. There is no access from the outside of the lock for a would be lock picker to defeat this secondary lock position.

While the present invention has been described with a certain degree of particularity, it should be appreciated that the invention is defined by the following claims construed in view of the prior art so that modifications or changes can be made to the embodiments of the present invention without departing from the inventive concepts herein.

What I claim is:

1. In cylinder lock apparatus comprised geneerally of a cylinder housing, a cylindrical key plug positioned rotatably in said cylinder housing and having a keyway channel extending longitudinally therethrough and a service pin bore extending radially therein from a peripheral surface to intersect said keyway channel, a chamber housing on said cylinder housing with a chamber pin bore therein extending radially outward in axial alignment with said service pin bore, a driver pin slideably positioned in said chamber pin bore and biased toward said key plug, a key bit adapted for removeable insertion into said keyway channel to engage said service pin, the improvement comprising:

said key plug also having a secondary bore therein in angular spaced relation to said service pin bore and extending radially inward in said key plug, said secondary bore being axially alignable with said chamber pin bore by rotation of said key plug in said cylinder housing, spacer means positioned in said secondary bore and being interactive with said key bit when said key bit is positioned in said keyway for prohibiting protrusion by said driver pin into said secondary bore while allowing protrusion therein by said driver pin when said key bit is not positioned in said keyway channel and said key plug is rotated to axially align said secondary bore with said chamber pin bore in such a manner as to prohibit further rotation of said key plug in relation to said cylinder housing, and lock means for preventing removal of said driver pin from said secondary bore once it has protruded therein.

2. The improvement of claim 1, wherein said secondary bore extends from said keyway channel radially outward to the peripheral surface of said key plug and said spacer means includes an elongated pin slideably positioned in said secondary bore and of a length equal to the distance between the peripheral surface of said key plug and said key bit when said key bit is positioned in said keyway channel.

3. The improvement of claim 1, wherein said lock means includes engagement means in said key plug for engaging said driver pin in said secondary bore in such a manner as to prevent longitudinal movement of said driver pin out of said secondary bore.

4. The improvement of claim 3, wherein said engagement means includes an engageable recess in said driver pin and a lock pin in said key plug positioned adjacent said secondary bore and adapted to slide into engagement with said recess when said driver pin is positioned partially in said secondary bore and across the shear line between said key plug and said cylinder housing.

5. The improvement of claim 4, including longitudinal tertiary bore in said key plug that intersects said secondary bore, said lock pin being slideably positioned in said tertiary bore and biased toward said secondary bore.

6. In cylinder lock apparatus comprised of a cylinder housing, a cylindrical key plug positioned rotatably in said cylinder housing and having a keyway channel extending longitudinally therethrough and a service pin bore extending radially therein from a peripheral surface to intersect said keyway channel, a chamber housing on said cylinder housing with a chamber pin bore therein extending radially outward in axial alignment with said service pin bore, a driver pin slideably positioned in said chamber pin bore and biased toward said key plug, and a service pin slideably positioned in said service pin bore, and a key bit adapted for removeable insertion into said keyway channel to engage said service pin, the improvement comprising:

a shuttle pin positioned slideably in a shuttle pin bore extending radially outwardly from said keyway in said key plug an angular spaced distance from said service pin bore and axially alignable with said chamber pin bore by rotating said key plug in relation to said chamber housing, said shuttle pin being of a length equal to the distance between the peripheral surface of said key plug and said key bit when said key bit is positioned in said keyway channel, and said shuttle pin bore also being adapted to receive a portion of said driver pin therein when said shuttle pin bore is aligned with said chamber pin bore and said key bit is not positioned in said keyway channel, and a lock pin positioned slideably in a lock pin bore in said key plug that intersects said shuttle pin bore, said lock pin being biased toward said shuttle pin bore and adapted to engage and retain said driver pin in said shuttle pin bore when said driver pin is positioned across the shear line between said key plug and said cylinder housing.

7. The improvement of claim 6, wherein said driver pin is spool shaped with an annular recess around its midsection large enough to receive therein one end of said lock pin when said driver pin is positioned in said shuttle pin bore with said annular recess aligned with the intersection of said lock pin bore with said shuttle pin bore.

8. The improvement of claim 6, wherein said lock pin bore extends longitudinally from the rear of said key plug forwardly to said shuttle pin bore, a coil spring is positioned behind said lock pin to bias it toward said shuttle pin bore, and a removable end cap at the end of said key plug encloses the opening to said lock pin bore and provides a surface against which said coil spring bears when assembled in operable condition.

* * * * *